US005421486A

United States Patent [19]

Simmons

[11] Patent Number: 5,421,486

[45] Date of Patent: Jun. 6, 1995

[54] APPARATUS FOR DISPENSING FLOWABLE PRODUCTS FROM TUBE-TYPE CONTAINERS

[76] Inventor: J. V. Simmons, 2229 St. Francis, Dallas, Tex. 75228

[21] Appl. No.: 278,833

[22] Filed: Jul. 22, 1994

[51] Int. Cl.[6] ..... B65D 35/34

[52] U.S. Cl. ..... 222/100

[58] Field of Search ..... 222/98–104

[56] References Cited

U.S. PATENT DOCUMENTS

| | | | |
|---|---|---|---|
| 1,421,777 | 7/1922 | Hawley et al. | 222/100 |
| 1,731,703 | 10/1929 | Bourke | 222/99 |
| 3,259,276 | 7/1966 | Chase | 222/100 |
| 3,381,857 | 5/1968 | Francis | 222/100 |
| 3,471,668 | 10/1969 | Wilkes | 222/102 X |
| 3,670,926 | 6/1972 | Hill | 222/99 X |
| 4,765,512 | 8/1988 | Bull, Jr. | 222/100 |
| 4,850,971 | 7/1989 | Colvin | 222/100 X |
| 4,998,645 | 3/1991 | Pearson | 222/98 |

FOREIGN PATENT DOCUMENTS

| | | | |
|---|---|---|---|
| 743429 | 9/1966 | Canada | 222/100 |

*Primary Examiner*—Andres Kashnikow
*Assistant Examiner*—Kenneth R. DeRosa
*Attorney, Agent, or Firm*—Harold E. Meier

[57] ABSTRACT

A dispenser including a rotatable rod with a flexible member attached thereto. The flexible member includes an opening at one end for receiving and retaining the cap end of a tube-type container filled with flowable material. The pinched end of the tube-type container is positioned between the flexible member and the rod. When the rod is rotated, the flexible member, along with the tube-type container, is drawn towards and wrapped around the rod. The force applied by the flexible member and rod on the tube-type container in wrapping the tube around the rod squeezes out a predetermined amount of flowable material for consumer use.

10 Claims, 1 Drawing Sheet

APPARATUS FOR DISPENSING FLOWABLE PRODUCTS FROM TUBE-TYPE CONTAINERS

TECHNICAL FIELD

The present invention relates to an apparatus for dispensing flowable products from tube-type containers.

BACKGROUND OF THE INVENTION

Although pump-type dispensers are becoming increasingly available, the most commonly used container for holding flowable products (such as toothpastes, lotions, salves, caulks, adhesives and sealants) remains the tube. Such tubes are typically made of plastic or other suitable material, capped on one end from which the flowable product is dispensed, and laterally pinched and sealed on the other end following the filling of the tube with the product.

Although tube-type containers for flowable products have been used for a number of years, the use of such containers continues to this day to be plagued by one problem—the inability of the consumer to extract substantially all of the contained product from the tube. In these times of heightened concern with the cost of purchased consumer goods, nothing frustrates a consumer more than to waste purchased flowable product by leaving it in the tube. Tube-type dispensers suffer from an additional drawback in that they are difficult for some persons, especially the elderly or disabled, to use. While a number of devices have been invented claiming to efficiently and easily remove flowable products from tube-type containers, these devices have typically been mechanically complicated, unreliable and/or expensive to produce. Accordingly, there is a need for a low cost, efficient and easy to use device for dispensing flowable products from tube-type containers.

SUMMARY OF THE INVENTION

The dispenser of the present invention includes a flexible member attached at a first end to the surface of a rotatably mounted rod. A second end of the flexible member includes a means for retaining the cap end of a flowable product tube-type container. To operate the dispenser of the present invention, the capped end of the tube-type container is retained by the means at the second end of the flexible member, and the pinched end of the container is positioned between the flexible member and the rod. When the rod is rotated, the tube-type container is drawn toward and wrapped around the rod. The force applied on the tube-type container by the flexible member and the rod in wrapping the tube around the rod efficiently squeezes out flowable product.

BRIEF DESCRIPTION OF THE DRAWINGS

A more complete understanding of the apparatus of the present invention may be had by reference to the following Detailed Description when taken in conjunction with the accompanying Drawings wherein.

DETAILED DESCRIPTION OF THE DRAWINGS

Figure 1:
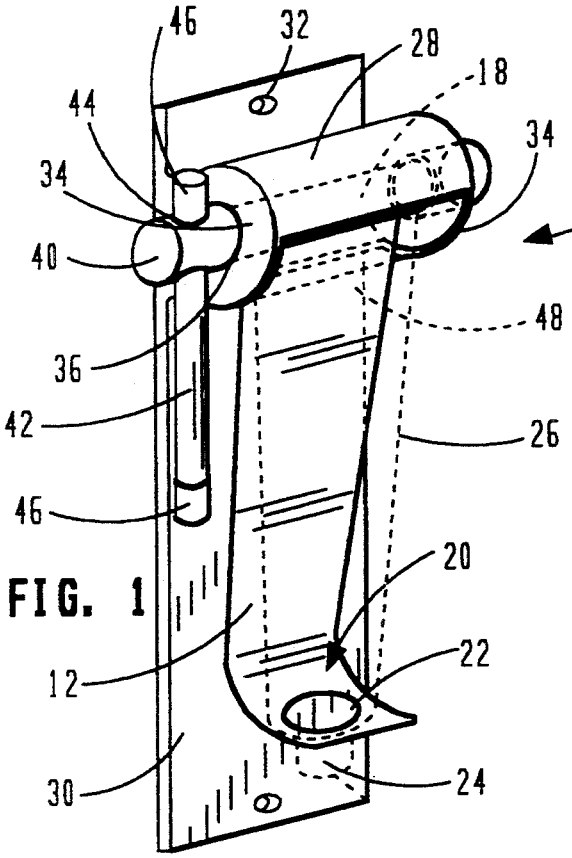
FIG. 1 is a perspective view of the preferred embodiment of the apparatus of the present invention.
Figure 2:
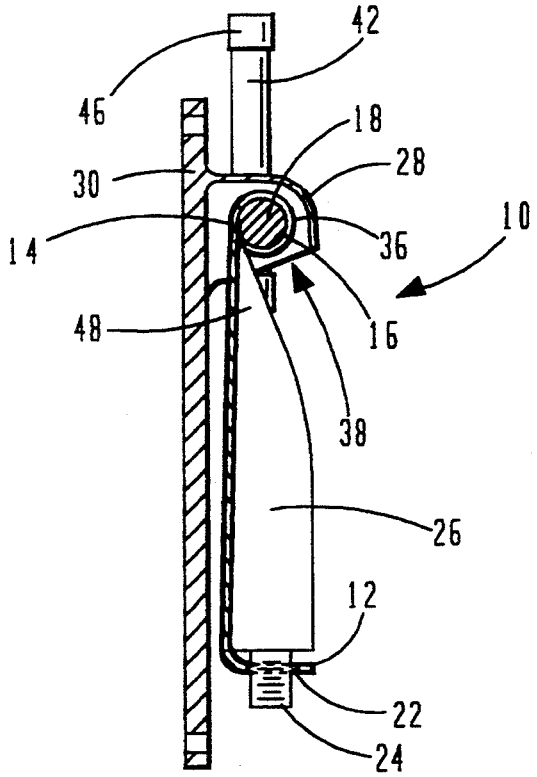
FIG. 2 is a side, partially cross-sectional view of the apparatus of the present invention shown in FIG. 1.

Referring now to FIGS. 1 and 2, there is shown the preferred embodiment of the dispenser 10 of the present invention. The dispenser 10 includes a flexible member 12 attached at a first end 14 to the surface 16 of a rod 18. The flexible member 12 is preferably manufactured of a suitable plastic or fabric material. A second end 20 of the flexible member 12 includes an opening 22 sized to allow for the insertion therethrough of the cap end 24 of a flowable material tube-type container 26 (shown in phantom in FIG. 1).

The dispenser 10 further includes a cylindrically-shaped housing 28 and mounting board 30 preferably unitarily molded or formed from a plastic material. The ends 34 of the housing 28 include circular openings 36 having a diameter slightly larger than the diameter of the rod 18. The rod 18 is inserted through, and is rotatable within the openings 36. The flexible member 12 that is attached to the surface of the rod 18 extends through an opening 38 in the surface of the cylindrical housing 28. A hole 32 is provided in the mounting board 30 to allow the dispenser 10 to be secured to a wall through the use of a nail, screw, hook or other means.

At one end 40 of the rod, a handle 42 is provided to rotate the rod 18 within the housing 28 and thereby actuate the dispenser 10 in a manner to be described. An opening 44 is provided in the rod end 40 for receiving the handle 42. The diameter of the opening 44 is sized to be slightly larger than the diameter of the handle 42 to allow the handle to slide through the opening 44 facilitating actuation of the dispenser when mounted to a wall. A pair of caps 46 are mounted at each end of the handle 42 to prevent the handle from falling through the opening 44.

Figure 3:
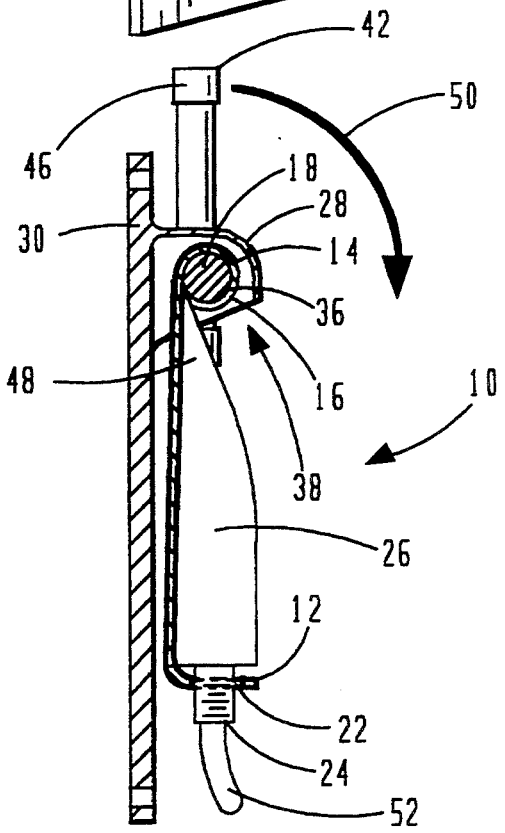
FIG. 3 is a side, partially cross-sectional view of the apparatus of the present invention in operation dispensing flowable product.

Reference is now made to FIGS. 2 and 3 to illustrate the operation of the dispenser 10 of the present invention. The flowable material tube-type container 26 is installed in the dispenser 10 by first inserting the cap end 24 through the opening 22 in the second end 20 of the flexible member 12. The pinched end 48 of the tube-type container 26 is then positioned between the flexible member 12 and the rod 18. To dispense flowable material from the tube-type container 26, the handle 42 is actuated in the direction shown by arrow 50 to rotate the rod 18 within the housing 28. As the rod rotates, the second end 20 of the flexible member 12 is drawn towards the housing 28 and the flexible member is wrapped around the rod 18. This action also draws the tube-type container 26 into the housing 28 to be wrapped with the flexible member 12 around the rod 18. The force applied by the flexible member 12 and rod 18 in wrapping the tube-type container 26 around the rod efficiently squeezes out flowable material 52 from the tube for consumer use. The amount of flowable material 52 that is dispensed from the tube-type container 26 is controlled by the amount of rod 18 rotation imparted by the actuation of the handle 42. Following the dispensing of flowable material, the cap may be returned to the cap end 24 of the tube-type container 26 or left off awaiting the next actuation and dispensing operation.

Figure 4:
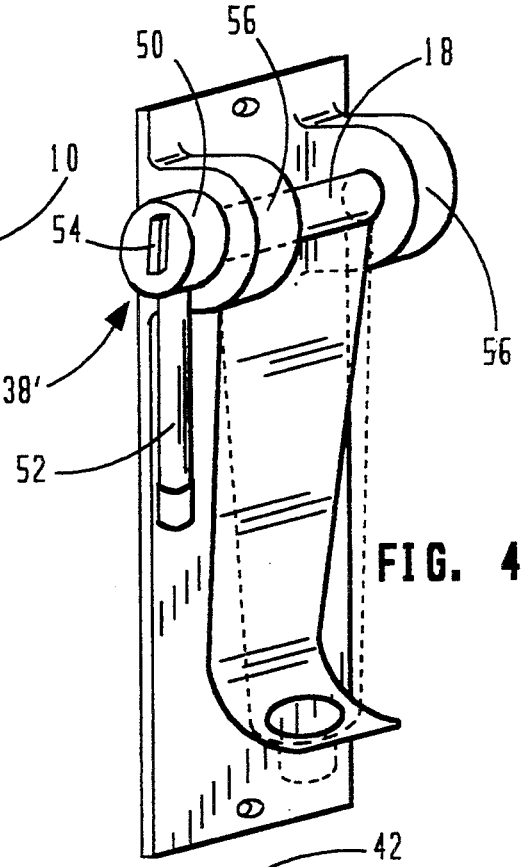
FIG. 4 is a perspective view of an alternative embodiment of the apparatus of the present invention.

Reference is now made to FIG. 4 wherein there are shown alternative embodiments for certain elements of the dispenser of the present invention. For example, the handle 38 shown in FIG. 1 has been replaced in FIG. 4 by a ratchet handle assembly 38'. The ratchet handle assembly 38' includes a ratchet mechanism 50 of known configuration and design mounted to permit rotation of the rod 18 in one direction to draw and wrap the flexible member 12 around the rod 18. A ratchet handle 52 is mounted to the mechanism 50 to actuate the dispenser 10 for dispensing flowable material. The mechanism 46 further includes a switch 54 for releasing the ratchet restraint and allowing the rod 18 to be rotated in an opposite direction for extending the flexible member 12 out from the housing 28 and replacing the tube-type container 26. The dispenser may further include a pair of brackets 56 in place of the housing 28 shown in FIG. 1 for rotatably mounting the rod 18.

Although preferred embodiments of the present invention have been illustrated in the accompanying Drawings and described in the foregoing Detailed Description, it is to be understood that the same is by way of illustration and example only and is not to be taken by way of limitation. The spirit and scope of the invention is to be limited only by the terms of the appended claims.

I claim:

1. Apparatus for dispensing flowable product stored in tube-type containers having a pinched end and a dispensing end, comprising:

a mounting board for supporting and affixing the tube-type container to a planar surface with the dispensing end below the pinched end;

a rotatable rod;

means for supporting the rotatable rod on said mounting board;

a flexible member having a first end and a second end, the first end secured to the rotatable rod;

means at the second end of the flexible member for retaining the tube-type container, said tube-type container positioned with the pinched end between the flexible member and the rod; and a handle affixed to the rod for rotating the rod to draw and wrap the flexible member around the rod, squeezing the tube-type container between the flexible member and rod to continuously dispense flowable product.

2. The apparatus as in claim 1 further including a cylindrical housing for supporting the rotatable rod, the flexible member extending from the rod through an opening in the housing.

3. The apparatus as in claim 1 wherein the flexible member comprises a sheet of fabric material.

4. The apparatus as in claim 1 wherein the flexible member comprises a sheet of plastic material.

5. The apparatus as in claim 1 wherein the means at the second end of the flexible member for retaining comprises an opening in the second end of the flexible member, the opening sized to receive the dispensing end of the tube-type container.

6. The apparatus as in claim 1 further including a ratchet mechanism mounted to an end of the rotatable rod and actuated by the rotatable handle.

7. Apparatus for dispensing flowable product stored in tube-type containers having a pinched end and a dispensing end, comprising:

a mounting board for supporting and affixing the tube-type container to a planar surface with the dispensing end below the pinched end;

a cylindrical housing affixed to said mounting board;

a rod rotatably supported by the cylindrical housing;

a flexible member having a first end and a second end, the first end secured to the rod, the second end extending from the cylindrical housing and having an opening for receiving and retaining a cap end of the tube-type container, said tube-type container positioned with the pinched end between the flexible member and the rod; and a handle affixed to the rod for rotating the rod to draw and wrap the flexible member around the rod, squeezing the tube-type container between the flexible member and rod to continuously dispense flowable product.

8. The apparatus as in claim 7 wherein the flexible member comprises a sheet of fabric material.

9. The apparatus as in claim 7 wherein the flexible member comprises a sheet of plastic material.

10. The apparatus as in claim 7 further including a ratchet mechanism mounted to an end of the rotatable rod and actuated by the rotatable handle.

* * * * *